United States Patent [19]

Bennett et al.

[11] 4,407,921

[45] Oct. 4, 1983

[54] ELECTROPHOTOGRAPHIC ELEMENTS WITH POLYESTER BINDER RESINS HAVING APROTIC END GROUPS

[75] Inventors: Everett W. Bennett, Longmeadow; Jan B. Suchy, Holyoke, both of Mass.

[73] Assignee: James River-Graphics, Inc., South Hadley, Mass.

[21] Appl. No.: 320,064

[22] Filed: Nov. 10, 1981

[51] Int. Cl.[3] ..... G03G 5/087; G03G 5/04

[52] U.S. Cl. ..... 430/96

[58] Field of Search ..... 430/96

[56] References Cited

U.S. PATENT DOCUMENTS

| | | | |
|---|---|---|---|
| 3,703,371 | 11/1972 | Merrill | 430/96 X |
| 3,703,372 | 11/1972 | Merrill | 430/96 X |
| 3,923,509 | 12/1975 | Kenhn | 430/96 X |
| 3,925,074 | 12/1975 | Wyhof | 430/96 X |
| 4,284,699 | 8/1981 | Berwick et al. | 430/96 |
| 4,296,190 | 10/1981 | Hasegawa et al. | 430/96 X |

FOREIGN PATENT DOCUMENTS

| | | | |
|---|---|---|---|
| 54-24635 | 2/1979 | Japan | 430/96 |

*Primary Examiner*—Roland E. Martin, Jr.

*Attorney, Agent, or Firm*—Burns, Doane, Swecker & Mathis

[57] ABSTRACT

Disclosed are electrophotographic elements comprising a support having coated thereon a photoconductive composition comprising a photoconductor dispersed in a linear film-forming polyester resin having its terminal hydroxyl and carboxyl groups endblocked with aprotic groups. The aprotic groups reduce hydrogen bonding within the resin matrix, and enhance the flowability of the resin when heated. Electrophotographic elements utilizing polyester resin binders endblocked in accordance with the present invention possess improved fusibility as compared with similar electrophotographic elements containing equivalent but protic endblocked polyester matrices, and as a result can be readily developed by flash fusing. In addition, such electrophotographic elements containing polyester resin binders endblocked in accordance with the instant invention possess improved photographic speed, and often improved dark decay properties, as compared with electrophotographic elements containing protic endblocked polyester matrices.

13 Claims, No Drawings

ELECTROPHOTOGRAPHIC ELEMENTS WITH POLYESTER BINDER RESINS HAVING APROTIC END GROUPS

BACKGROUND OF THE INVENTION

The present invention relates to novel electrophotographic elements containing photoconductive layers comprising a polyester resin matrix having photoconductors dispersed therein. More particularly, the present invention relates to a new class of polyester resins which are highly advantageous for use as matrix polymers in electrophotographic elements, producing a significant improvement in the photographic speed, and in many cases, the dark decay properties of the system. In addition, electrophotographic elements containing matrices of these polymers are readily developed by fusing techniques, such as for example flash fusing development techniques.

Electrophotographic elements containing photoconductive layers of polyester resin matrices and dispersed photoconductors are well known in the art. See, for example, U.S. Pat. Nos. 3,703,371 and 3,703,372. In such materials, a sensitizer is frequently employed together with the photoconductor. In systems of this type, the electrostatic latent image photographic speed depends upon the sensitization and carrier generation efficiency as well as the carrier transport rate, i.e., it is theoretically possible to have a very light sensitive film that affords little or no latent image due to poor carrier transport. The matrix can thus affect the useful photographic speed for such film by determining the magnitude of the final voltage drop as well as the time to achieve it. The polyester resins heretofore known in the art have generally contributed to the photographic speed only in those few cases where the polyester resin forms a co-crystalline complex with the sensitizer molecule. As a result, the photographic speed of films based on many of the known polyester resin matrices has been less than desirable.

Moreover, electrophotographic elements containing polyester matrices frequently possess less than desirable dark decay properties, i.e. the ability of the electrophotographic element to retain a stable charge level on the film surface in the dark. As a result of charge decay, in electrophotographic elements having poor dark decay properties, the image quality is dependent on the time elapsed between charging and exposure as well as exposure and development, a condition which is commercially undesirable.

In addition, the polyester matrices heretofore employed in the prior art have possessed poor fusibility, and electrophotographic elements containing matrices of these polyesters have been especially difficult to fix by the flash fusing technique. As is well known to those skilled in the art, flash fusing techniques comprise a highly attractive method of image fixation due to both its convenience and the high level of image permanence resulting therefrom. As mentioned above, this type of image fixation technique has been difficult to achieve with electrophotographic elements containing the polyester matrices which have heretofore been employed in the art.

Polyester resins useful as photoconductive matrices in electrophotographic films must not only possess excellent dielectric properties, but must also have a glass transition temperature (Tg) sufficiently high that the formulated film does not exhibit a blocking tendency when in contact with itself or another surface. In addition, in order to achieve a desirable level of physical properties with respect to fracture radius, adhesion, crinkle phenomena, etc., it is usually necessary to employ polyester resins having moderately high molecular weights, e.g. above 20,000 molecular weight units. This, however, results in a film that does not have the proper rheology to flow well under the conditions necessary to the fixation of an electrophotographic image having satisfactory image durability by fusing techniques. The obvious compromise, the use of very low molecular weight polymers, which improving the fusibility of the film, requires a sacrifice in the other desirable physical properties of the film discussed above. In addition, the use of lower molecular weight resins can result in a serious loss of dark decay and photographic speed characteristics.

The compromise referred to above, moreover, is not without limitation, and the molecular weight of the polyester resin must be sufficiently high to provide the minimum level of glass transition temperature, adhesion, fracture radius, etc. necessary to the preparation of useful film. The end result is that the polyester resins heretofore employed as photoconductor matrices in electrophotographic elements have exhibited adequate physical properties while at the same time being difficultly fusible with electrophotographic toner particles by the flash fusing technique. In addition, as discussed above, electrophotographic films containing matrices of these resins have generally possessed less than desirable photographic speed and dark decay properties. Accordingly, the development of a new class of polyester resins which possess a molecular weight sufficient to maximize physical properties, photographic speed and dark decay properties, while at the same time being readily fusible with electrophotographic toners by flash fusing or other similar techniques, would be a highly desirable contribution to the art.

SUMMARY OF THE INVENTION

Accordingly, it is an object of the present invention to provide a new class of polyester resins which are suitable for use as photoconductor matrices in photoconductive elements useful in electrophotography.

It is a specific object of the instant invention to provide a new class of electrophotographic polyester matrix resins which have improved fusibility, photographic speed and dark decay properties, without a sacrifice of the desirable physical properties of the resins.

It is a particular object of the present invention to provide novel electrophotographic elements containing polyester photoconductor matrices which have improved photographic speed, dark decay properties and are readily developed using fusing fixation techniques.

A more specific object of the instant invention is the provision of novel electrophotographic elements containing polyester photoconductor matrices which have improved photographic speed, dark decay properties and are readily fixed using flash fusing image fixation techniques.

In accomplishing the foregoing and other objects, there has been provided in accordance with the present invention photoconductive elements suitable for use in electrophotography comprising a support having coated thereon a photoconductive composition comprising a photoconductor and a binder for the photoconductor comprising a linear, film-forming polyester resin having the terminal hydroxyl and carboxyl groups thereof modified with an aprotic group. In contrast to the prior art, electrophotographic elements in accordance with the present invention have improved fusibility, and are readily fixed by fusing with electrophotographic toners. In addition, it has been unexpectedly found that such electrophotographic elements possess improved photographic speeds, and in many cases improved dark decay properties, as compared with electrophotographic elements containing conventional polyester photoconductor matrices.

Other objects, features and advantages of the present invention will become apparent to the skilled artisan upon examination of the following detailed description of the present invention.

DETAILED DESCRIPTION OF THE INVENTION

The essence of the instant invention comprises the unexpected discovery that by replacing the usual hydroxyl and carboxyl endgroups of polyester matrix resins with aprotic groups, photographic speed, image fusibility and in many cases the dark decay properties of the film are substantially improved. Those skilled in the art will readily appreciate the advantages of the polyester resin matrices of the present invention since improved fusibility with the electrodeveloper or toner particles relates directly to improved image durability. The electrophotographic films of the present invention thus not only accrue improved photographic speeds and dark decay properties, but due to their improved fusibility, enhanced image durability.

While not wanting to be bound to any specific theory, it is believed that the aprotic groups reduce hydrogen bonding in the polymer matrix, improving the melt flow and fusibility properties of the electrophotographic element. Whatever the theory involved, it has been discovered that high glass transition temperature (Tg) polyesters having molecular weights great enough to afford acceptable physical properties such as film toughness, flexibility, fracture radius, adhesion, crinkle properties etc, but which are not readily, if at all, fusible with electrophotographic toners can be made fusible by capping the polymer's hydroxyl and carboxyl endgroups with aprotic groups. In addition, it has been found that the aprotic groups reduce the solution viscosities of the resins in coating solvents and thus improve the quality of solution coated electrophotographic elements.

The aprotic groups of the polyester resins employed in the electrophotographic elements of the subject invention may comprise any group such as is well known to those skilled in the art which does not contain hydrogen atoms capable of hydrogen bonding with other molecules, i.e. a group which has a negligible tendency to donote protons to a reference base such as water. Accordingly as used herein, the term "aprotic group" refers to any of those groups well known to those skilled in the art which do not readily donate protons. In addition, it is desirable that synthesis of the particular aprotic group endblocked polyester be possible without significant molecular chain scission of the polyester chain. In other words, preferred aprotic groups for use in the instant invention include those groups which are capable of being introduced into the polyester resin without significant molecular chain scission. Examples of groups which satisfy the foregoing requirements include ether, ester, urethane, amide and other monovalent groups to which the terminal hydroxyl and carboxyl groups of the resin can be converted without significant scission of the polymer chain.

More than one type of aprotic group may be present, moreover, and frequently will be present on the modified resin due to the fact that the non-modified resins often contain both hydroxyl and carboxyl groups which give rise to different aprotic groups when reacted with a given reagent. The various possible combinations of aprotic groups are chosen such that substantially all the protic hydroxy and carboxyl groups of the polyester resin are replaced by aprotic groups.

Examples of preferred ether groups for use in the endblocked polyester resins of the present invention include those groups of the formula $—OR^1$, wherein $R_1$ is an alkyl group such as for example alkyl groups having from 1 to 18 carbon atoms, e.g. methyl, ethyl, propyl, isopropyl, butyl, pentyl, hexyl, heptyl, octyl, nonyl, decyl, etc.; cycloalkyl, such as cycloalkyl groups having from 4 to 7 carbon atoms, of which cyclohexyl is most preferred; alkaryl groups having 7 to 11 carbon atoms in the aromatic nucleus, including benzyl and its derivatives; and alkenyl groups of 3 to 18 carbon atoms, including particularly allyl and Δ2,3-cycloalkenyl.

Preferred ester aprotic groups include those groups of the formula $$-\overset{\overset{\displaystyle O}{\|}}{C}-OR^2,$$

wherein $R^2$ is a group such as has been set forth above with respect to $R^1$, as well as suitable sulfur analogs of the same.

The urethane and amide groups preferably comprise those amide and urethane groups of the formulae $R^3$—NHCO— and $R^3$NHCOO—, respectively, wherein $R^3$ is an alkyl group such as for example alkyl groups having from 1 to 18 carbon atoms, including methyl, ethyl, propyl, butyl, pentyl, hexyl, heptyl, octyl, nonyl, decyl, dodecyl, tetradecyl, hexadecyl, octadecyl, etc; aryl groups having 6 carbon atoms in the aromatic nucleus such as phenyl and phenyl substituted with electron withdrawing groups such as nitro, cyano, halogen, ester and tertiary amide, specific examples of which include p-chlorophenyl, 2,5-dichlorophenyl, p-nitrophenyl, di-nitrophenyl and p-cyanophenyl, as well as naphthyl, biphenyl and the substituted naphthyl and biphenyl groups which are substituted with electron withdrawing groups such as nitro, cyano, halogen, etc.; and alkaryl groups such as benzyl and substituted benzyl wherein the aromatic ring contains one of the aforementioned electron withdrawing groups. Particularly preferred urethane and amide groups include those groups wherein $R^3$ is an alkyl group of from 1 to 4 carbon atoms, phenyl, substituted phenyl containing electron withdrawing groups such as nitro, cyano, halogen, ester, tertiary amides or combinations thereof, of which n-butyl and the various chlorine substituted phenyl groups are most preferred.

Of the various aprotic groups exemplified above, the urethane and amide groups are most preferred since as will be discussed more fully hereinafter polyester resins endblocked with such groups may readily be prepared via a simple one-step procedure without the danger of chain scission by reacting, for example, a polyester resin with a suitable isocyanate compound. Diisocyanate compounds may also be utilized for this purpose, particularly where a moderate amount of chain extension is desired, provided any residual isocyanate endblock groups are rendered stable by conversion to a urethane or amide group. This may readily be done by treatment of the isocyanate endblocked resin with an alcohol, such as for example, methanol, ethanol, isopropanol, isobutanol, tert-butanol, etc. or a carboxylic acid, as will be explained more fully hereinafter.

In addition, it has been found that the aryl substituted urethane and amide groups accrue a particularly significant improvement in photographic speed. In this regard, aprotic urethane and amide groups derived from the various phenyl isocyanates such as phenylisocyanate, p-chlorophenylisocyanate, 2,5-dichlorophenylisocyanate, and p-nitrophenylisocyanate are particularly outstanding.

The polyester residue of the endblocked polyesters employed in the electrophotographic elements of the instant invention is not critical, and may comprise any polyester resin well known to those skilled in the art having that combination of physical properties suitable for electrophotographic uses. Such polyesters will typically comprise the linear, film-forming polyesters having a glass transition temperature (Tg) of from about 50° C. to 180° C., preferably 70° C. to 150° C., and a number average molecular weight of from about 8,000 to about 50,000, with polyesters having number average molecular weights of at least 10,000 molecular weight units and preferably from 12,000 to 35,000 molecular weight units being particularly preferred. Polyesters having molecular weights above 15,000 are particularly preferred since these resins possess the toughness, flexibility and glass transition temperature most desirable for use in electrophotographic films. Examples of suitable polyesters include the polyesters of U.S. Pat. Nos. 3,703,371 and 3,703,372, the entirety of which are hereby expressly incorporated by reference; Goodyear 321-1-SC-1 polyester (a linear film-forming polyester comprising as the glycol component 60 mole percent ethylene glycol and 40 mole percent cyclohexanedimethanol, and as the dicarboxylic acid component 60 mole percent terephthalic acid and 40 mole percent phenylindane dicarboxylic acid); USM 7977 polyester (a linear film-forming polyester based on ethylene glycol, cyclohexanedimethanol and phenylindane dicarboxylic acid); USM 7942 polyester (a linear film-forming polyester based on a proprietary mixture of dibasic acids and glycols); and Goodyear PE 200 polyester (a linear film-forming polyester containing terephthalic acid, isophthalic acid, ethylene glycol, and neopentylglycol).

It is of course understood that at very high molecular weights, the polymer endgroup content is vanishingly small percentage-wise so that the introduction of aprotic endgroups on such large molecular weight polymers has a smaller influence on polymer melt flow properties than with lower molecular weight polymers. Accordingly, the present invention is of greatest practical value with the low to moderate molecular weight polymers (e.g., polymers having a molecular weight of from 8,000 to 50,000, and most preferably from 12,000 to 35,000). Polyesters in this molecular weight range have the further advantage of being easier to make and have more acceptable solution viscosities for coating purposes.

The endblocked polyester resins of the present invention can be prepared by any method well known to those skilled in the art which does not degrade the polyester resin's degree of polymerization or otherwise adversely affect the polymer. By way of illustration, polyesters endblocked with the various classes of aprotic groups listed above can be prepared as follows.

A. Urethane and/or Amide Endblocked Polyesters

The urethane and/or amide endblocked polyesters may be conveniently prepared by reacting a suitable polyester resin with a monoisocyanate or diisocyanate in an unreactive solvent such as toluene, in the presence of a small amount of a urethane-forming catalyst such as dibutyltin dilaurate according to the following reaction sequences wherein R comprises the residue of a polyester chain, $R^3$ is as defined above, and $R^4$ comprises a straight or branched chain alkyl group having from 1 to 10 carbon atoms. As has been discussed above, the alcohol $R^4OH$ is employed subsequent to treatment of the polyester resin with a diisocyanate compound in order to remove any residual isocyanate groups in the resin and to stabilize the same (see equation II below).

1. Hydroxyl Terminated Resins $$HO-R-OH + 2R^3NCO \xrightarrow[\text{dibutyltin dilaurate}]{\text{toluene}} R^3NHC(=O)-O-R-O-C(=O)-NHR^3 \quad (I)$$

$$HO-R-OH + 2OCNR^3NCO \xrightarrow[\text{dibutyltin dilaurate}]{\text{toluene}} OCNR^3NHC(=O)-O-R-O-C(=O)-NHR^3NCO \quad (II)$$

$$OCNR^3NHC(=O)-O-R-O-C(=O)-NHR^3NCO \xrightarrow{R^4OH\ (\text{e.g. ethanol})} EtO-C(=O)-NHR^3NHC(=O)-O-R-O-C(=O)-NHR^3NH-C(=O)-OEt$$

2. Carboxyl Terminated Resins $$HOOC-R-COOH + 2R^3NCO \xrightarrow[\text{dibutyltin dilaurate}]{\text{toluene}} R^3NHCO-C(=O)-R-C(=O)-OCNHR^3 \quad (III)$$

$$R^3NHCO-C(=O)-R-C(=O)-OCNHR^3 \xrightarrow{-2CO_2} R^3NHC(=O)-R-C(=O)NHR^3$$

$$HOOC-R-COOH + 2OCNR^3NCO \xrightarrow[\text{dibutyltin dilaurate}]{\text{toluene}} \quad (IV)$$

-continued

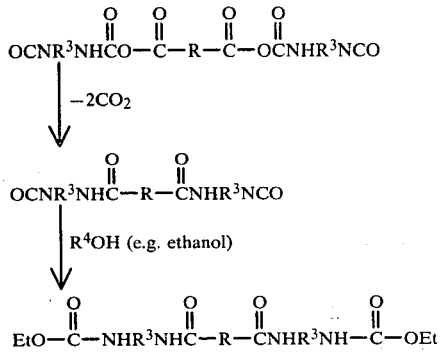

3. Hydroxyl and Carboxyl Terminated Resins

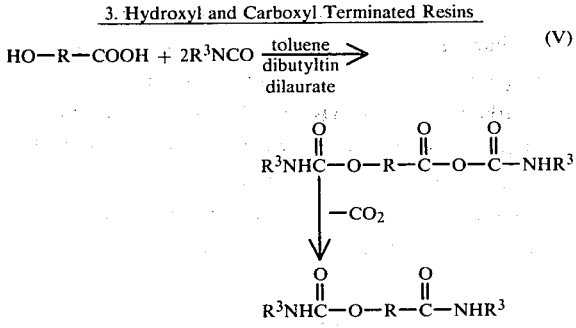

(V)

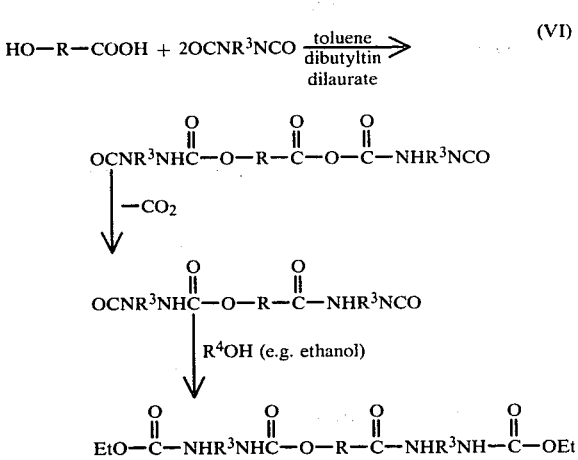

(VI)

As can be seen from equations I–IV, treatment of a polyester resin terminated with hydroxyl or carboxyl groups with a mono- or diisocyanate produces a polyester resin endblocked with urethane and amide groups, respectively. On the other hand, as can be seen from equations V–VI, treatment of a polyester resin containing both carboxyl and hydroxyl groups with a mono- or diisocyanate produces an aprotic endblocked resin containing both urethane and amide groups.

B. Ether and/or Ester Endblocked Polyesters

1. Hydroxyl Terminated Resins a. Esterification via reaction with an acyl halide, such as for example acetyl chloride in the presence of an acid acceptor such as for example triethylamine, followed by removal of the amine-acid salt by-product:

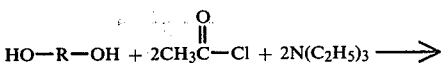

(VII)

-continued

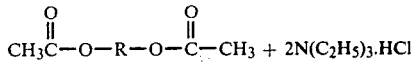

b. Esterification via reaction with an acid anhydride (e.g. acetic anhydride), followed by removal of the byproduct acid (e.g. removal of acetic acid):

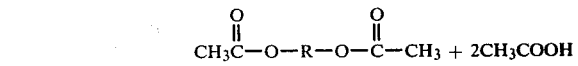

(VIII)

c. Esterification via treatment with a suitable ketene (e.g. $CH_2{=}C{=}O$):

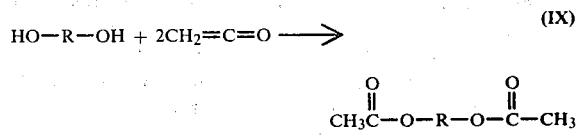

(IX)

d. Phase transfer esterification using a quaternary salt transfer agent and an acid chloride (*Synthesis,* 822, October, 1979):

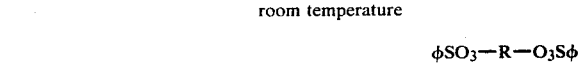

(X)

e. Etherification via reaction with diazomethane (See, *Basic Principles of Organic Chemistry,* J. D. Roberts and M. C. Caserio, W. A. Benjamin, Inc., New York, 1965, page 561):

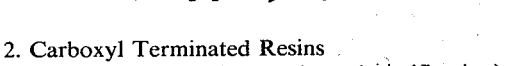

(XI)

2. Carboxyl Terminated Resins a. Reaction with diazomethane (esterification):

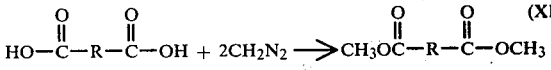

(XII)

b. Carbodiimide promoted esterification (see, *Synthesis,* 755, September 1979; A. Hassner and V. Alexandria, *Tetrahedron Letters,* 4475 (46) 1978):

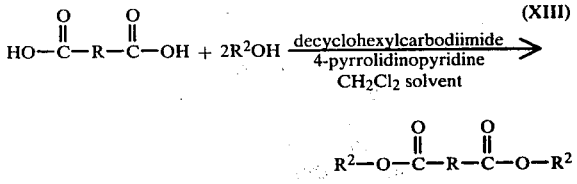

(XIII)

3. Hydroxyl and Carboxyl Terminated Resins

The hydroxyl and carboxyl end groups of polyester resins terminated with both types of endgroups may be readily converted into aprotic ether and ester groups, respectively, by a simple one-step reaction with diazomethane (see *Basic Principles of Organic Chemistry,* supra. at pages 421, 561):

$$HO-R-COOH + 2CH_2N_2 \xrightarrow{BF_3} CH_3O-R-\overset{\overset{O}{\|}}{C}-OCH_3 \quad (XIV)$$

The novel polyester matrix polymers of this invention improve the electrophotographic speeds and, in many cases dark decay properties, of electrophotographic elements containing a wide variety of photoconductors, including both the inorganic and organic types of photoconductors. Examples of suitable photoconductors are described in U.S. Pat. Nos. 3,703,371; 3,703,372; 3,542,547; 3,730,000; 4,047,949; and 4,140,529, the entirety of which are herein expressly incorporated by reference. Preferred photoconductors comprise the organic photoconductors such as for example, the substituted metaphenylene diamines, the various amine derivatives of the triarylmethanes, phenothiazines, phthalocyanines and the aminofluorenes.

Particularly preferred organic photoconductors comprise the organic photoconductors described in applicants' copending application Ser. No. 320,068, filed concurrently herewith, the entirety of which is herein expressly incorporated by reference. Such photoconductors comprise hindered triarylmethanes having the following structural formula:

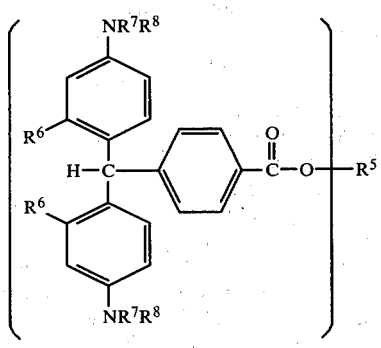

wherein n is an integer from 1-2; $R^7$ and $R^8$ are alkyl or aralkyl; $R^6$ is alkyl; and $R^5$ is alkyl, aralkyl, alkylene, arene having 6 carbon atoms in the aromatic nucleus, or polyether containing up to 10 ether units, and when n is 2, a divalent linking radical selected from the group consisting of alkylene, arene having 6 carbon atoms in the aromatic nucleus and divalent polyether groups containing up to 10 ether units. Photoconductors of this type exhibit particularly outstanding electrophotographic speeds. In addition, those compounds containing a carboxyester group at the 4″ position possess improved blooming properties as comared with other conventional photoconductors.

The amount of photoconductor employed can vary widely. Generally, the photoconductor will comprise from about 10-60% by weight, preferably 10-40% by weight, and most preferably 15-30% by weight of the electrophotographic element.

The photoconductive elements of the invention can also be sensitized by the addition of effective amounts of sensitizing compounds to exhibit improved electrophotosensitivity. Sensitizing compounds useful in the electrophotographic elements of the present invention can be selected from a wide variety of materials, including such materials as the pyrilium salts including the thiapyrilium and selenapyrilium dye salts disclosed in Van Allan et al, U.S. Pat. No. 3,250,615; fluorenes, such as 7,12-dioxo-13-dibenzo(a,h)fluorene, 5,10-dioxo-4a,11-diazabenzo(b)fluorene, 3,13-dioxo-7-oxadibenzo(b,g)fluorene, and the like; aromatic nitro compounds of the type described in U.S. Pat. No. 2,610,120; anthrones such as those disclosed in U.S. Pat. No. 2,670,284; the quinones of U.S. Pat. No. 2,670,286; the benzophenones of U.S. Pat. No. 2,670,287; the thiazoles of U.S. Pat. No. 2,732,301; carboxylic acids, such as dichloroacetic acide and chlorendic acid; and various dyes, such as cyanine (including carbocyanine), merocyanine, diarylmethane, triarylmethane, thiazine, azine, oxazine, xanthene, phthalein, acridine, azo, anthraquinone dyes and the like, and mixtures thereof. Other sensitizers suitable for use in the photoconductive elements of the instant invention include the UV and charge transfer sensitizers such as for example Micheler's Ketone, tri and tetranitrofluoronone and 9,10 phenanthrenequinone. The sensitizers preferred for use in the photoconductive elements of this invention comprise the sensitizer dyes, such as for example, the triarylmethane, oxazine and cyanine dyes; the pyrilium and thiapyrilium salts; and the charge transfer sensitizers.

Though a sensitizer is not necessary to impart photoconductivity to the photoconductive element, and accordingly the use thereof is not mandatory, an effective amount of the sensitizer is frequently mixed with the photoconductor and binder, since the use of relatively small amounts of sensitizing compound give substantial improvement in the speed of the film. The amount of sensitizer that can be added to a photoconductive composition to provide effective increases in speed can vary widely. The optimum concentration in any given system will vary with the specific photoconductor and sensitizing compound used. In general, if a sensitizer is utilized, it will be employed in an amount of up to about 5% by weight, preferably from about 0.01 to 1% by weight, and most preferably in an amount of less than 0.1% by weight of the photoconductive layer, especially if a transparent film is desired.

In the preferred embodiment, the photocnductive elements of the present invention preferably comprise a support having coated thereon a photoconductive insulating layer comprising from about 10 to about 60% by weight of an organic photoconductor such as for example one of the triarylmethane photoconductors disclosed in applicants' copending application Ser. No. 320,068, a substituted metaphenylene diamine, amine substituent triarylmethane, phenothiazine, phthalocyanine or aminofluorene; together with up to 5% by weight of a dye sensitizer such as the triarylmethane, oxazine or cyanine dyes, the pyrilium and thiapyrilium salts, or the charge transfer sensitizers, dispersed in an aprotic endblocked, polyester resin matrix in accordance with the present invention having a number average molecular weight of from 12,000 to 35,000. Such photoconductive elements exhibit a particularly attractive combination of electrophotographic speed, preexposure fatigue resistance, blooming stability, dark decay properties and fusibility.

In preparing the photoconductive elements of the present invention, a photoconductive coating composition is prepared by dissolving a suitable photoconductor with the polyester resin matrices of the instant invention, optionally together with a sensitizer, in a suitable organic solvent, such as for example, benzene, toluene, acetone, 2-butanone, chlorinated hydrocarbons such as methylene chloride, ethylene chloride, and the like; ethers, such as tetrahydrofuran and the like; ketones, such as for example, methyl ethyl ketone, or mixtures thereof. The resulting photoconductive coating composition is thereafter coated onto a suitable support, the coating thickness of which can vary widely. Normally, a wet coating thickness in the range of about 0.0005 inches to about 0.01 inches is employed. A preferred range of coating thicknesses is from about 0.001 inches to about 0.006 inches before drying, although such thicknesses can vary widely depending upon the particular application desired for the electrophotographic element.

Suitable supporting materials may comprise any of the supports well known to those skilled in the art. Examples of suitable materials include, for example, conductivized paper (at a relative humidity above 20%); aluminum-paper laminates; metal foils, such as aluminum foil, zinc foil, etc.; metal plates, such as aluminum, copper, nickel, zinc, brass, and galvanized plates; and vapor deposited conductive layers such as silver, nickel, aluminum or conductive metal oxide, sulfide or iodide layers on conventional film supports such as cellulose acetate, poly(ethylene terephthalate), polystyrene, polycarbonate, polysulfone and the like; or any of the preceding polymer supports containing an ionically conductive layer of, for example, polymers of quaternary ammonium salts. Preferred polymer films for use in the supports include the polyester films, such as for example, poly(ethylene terephthalate), the polycarbonate films, polysulfone films and polystyrene films, with the poly(ethylene terephthalate) films being most preferred. For many utilities, it is also frequently desirable to employ a transparent support, such as for example, a transparent polyester film support.

A particularly useful photoconductive element for film applications in accordance with the present invention comprises a transparent polyester film support having a conductive ground layer comprising a metallized transparent vacuum deposited film of aluminum, nickel or a semi-conductor such as indium oxide, tin oxide or cadmium oxide or mixtures of such oxides, copper sulfide, cuprous iodide, or an ionically conductive film of various quaternary ammonium salt polymers, coated with a photoconductive insulating layer comprising from about 10 to 60% by weight of one of the triarylmethane photoconductor compounds disclosed in applicants' copending application Ser. No. 320,068, together with up to 5% by weight of a triarylmethane, oxazine, cyanine, pyrilium salt, thiapyrilium salt, or charge transfer sensitizer, dispersed in one of the aprotic endblocked polyester resins of the instant invention, wherein the polyester residue has a number average molecular weight of from 12,000 to 35,000.

The photoconductive elements of the present invention can be employed in any of the electrophotographic processes well known to those skilled in the art which require photoconductive layers. One such process is the xerographic process. In a process of this type, an electrophotographic element held in the dark, is given a blanket electrostatic charge by placing it under a corona discharge to give a uniform charge to the surface of the photoconductive layer. This charge is retained by the layer owing to the substantial dark insulating property of the layer, i.e., the low conductivity of the layer in the dark. The electrostatic charge formed on the surface of the photoconductive layer is then selectively dissipated from the surface of the layer by imagewise exposure to light by means of a conventional exposure operation such as for example, by a contact-printing technique or by lens projection of an image, or reflex or bireflex techniques and the like, to thereby form a latent electrostatic image in the photoconductive layer. Exposing the surface in this manner forms a pattern of electrostatic charge by virtue of the fact that light energy striking the photoconductor causes the electrostatic charge in the light struck areas to be conducted away from the surface in proportion to the intensity of the illumination in a particular area.

The charge pattern produced by exposure is then developed or transferred to another surface and developed there, i.e., either the charged or uncharged areas rendered visible, by treatnent with a medium comprising electrostatically responsive particles having optical density. The developing electrostatically responsive particles can be in the form of a dust, or a powder and generally comprise a pigment in a resinous carrier referred to as a toner. A preferred method of applying such a toner to a latent electrostatic image for solid area development is by the use of a magnetic brush. Methods of forming and using a magnetic brush toner applicator are described in the following U.S. Pat. Nos. 2,786,439; 2,786,440; 3,786,441; 2,811,465; 2,874,063; 2,984,163; 3,040,704; 3,117,884; and reissue Re. 25,779. Liquid development of the latent electrostatic image may also be used. In liquid development the developing particles are carried to the image-bearing surface in an electrically insulating liquid carrier. Methods of development of this type are widely known and are described, for example, in U.S. Pat. No. 2,297,691 and in Australian Pat. No. 212,315. In dry developing processes the most widely used method of obtaining a permanent record is achieved by selecting a developing particle which has as one of its components a low-melting resin. Heating the powder image then causes the resin to melt or fuse into or on the element. The powder is, therefore, caused to adhere permanently to the surface of the photoconductive element, forming an image of high durability. In other cases, a transfer of the charge image or powder image formed on the photoconductive element can be made to a second support such as paper which would then become the final print after developing and fusing or fusing respectively. Techniques of the type indicated are well known in the art and are described, for example, in U.S. Pat. Nos. 2,297,691 and 2,551,582.

Due to their excellent fusibility, a preferred method of developing the electrophotographic films of the subject invention comprises fusing the electrophotographic element with electrodeveloper particles. As has been described above, this type of development process produces an highly durable image, with obvious photographic advantages. While the endblocked polyester resins of this invention will improve the ability of an electrophotographic element to be developed by any of the vapor, oven, or flash fusing techniques, a particular improvement in developability is attained with the flash fusing technique since in this type of development process the amount of available heating time is quite limited.

The photoconductive elements of the present invention can be used in electrophotographic materials having many structural variations. For example, in addition to the photoconductive elements described above, multiple layers of the photoconductive composition can be coated on a suitable support. Likewise, multiple layered structures can be built up by interposing layers of insulating material or other photoconductive material between the photoconductive layers containing the aprotic endblocked polyester resins of the present invention.

In order to more fully describe the present invention, the following examples are presented which are intended merely to be illustrative and not limitative.

EXAMPLE I

A series of electrophotographic films were prepared containing non-endblocked polyester matrices, and polyester matrices endblocked with various aprotic urethane and amide groups, in order to demonstrate the improved electrophotographic speed, dark decay, and fusibility of electrophotographic films containing the endblocked polyesters of the subject invention. Each of the sample films tested contained 25 weight percent of a triarylmethane organic photoconductor and 0.03% by weight of an ethyl violet sensitizer, uniformly dispersed in an electrophotographic polyester resin commercially available from the Bostik Division of the USM Corp. under the designation USM 7942. This type of polyester comprises a linear, film-forming polyester having a molecular weight ranging between 14,000 and 28,000, a hydroxyl end group concentration described by an OH number of from 1–2, and a carboxyl endgroup concentration of about 3 to 6.

The urethane/amide endblocked polyester resin utilized in each of these sample films was prepared by heating 200 grams of polyester resin flakes in a three-neck reaction flask in 425 ml of toluene with stirring under a nitrogen atmosphere. The solution was maintained at reflux for about an hour until all water had azeotroped into a Dean-Stark trap. After readjusting the solution temperature to 100° C., a slight stoichiometric excess of the corresponding isocyanate in 25 ml of toluene was added to the reaction flask, and an initial infra-red scan of the reaction solution was recorded. Five ml of a urethane catalyst comprising dibutyltindilaurate in toluene (0.20 grams per 10 ml of toluene) were then added, and the flask maintained at 100° C. with stirring until the infra-red scans indicated that either no isocyanate remained or that the reaction had gone to completion as evidenced by no further consumption of isocyanate. Residual isocyanate was next scavenged from the reaction mixture by adding 0.5 ml of 1-propanol to the solution at room temperature. The solids content of the solution was then adjusted to about 27 weight percent by adding 188.3 grams of methylethyl ketone.

A photoconductive coating solution was thereafter prepared from the solution of urethane/amide endblocked polyester by the addition of the triarylmethane photoconductor and the ethyl violet sensitizer. This coating solution was then solution coated upon a 5 ml polyester support conductivized with semitransparent aluminum to give an electrophotographic film sample. Films containing non-endblocked polyester matrix were prepared in an analogous manner by forming a coating solution of the resin, photoconductor and sensitizer, and then solution coating the aforementioned support therewith.

The relative electrophotographic speeds of each of the sample films were measured by measuring the amount of exposure required to reduce an initial 1,000 volt surface charge to one-half its initial value, using as a standard a similar electrophotographic film containing as the photoconductor matrix polymer, Goodyear PE 200 polyester resin (not endblocked as per this invention), the speed of which was assigned an arbitrary value of 1. The dark decay properties of each sample film were measured from an initial voltage of 1000 volts, using as a standard an electrophotographic film based on Goodyear PE 200 polyester resin (non-endblocked), which was again assigned an arbitrary value of 1. The flash fusibility properties of each sample film were tested by forming a latent image on each of the sample films and then developing the samples in an A. B. Dick Co. S-200 Record Processor, with a commercially available electrophotographic developer available from A. B. Dick Co. under the trade designation S-200.

The results of these experiments are set forth in Table I.

TABLE I

| Resin | Endblocking Agent | Speed (Rel.) | Dark Decay (Rel.) | Flash Fusible |
|---|---|---|---|---|
| 1. Goodyear PE-200 | None | 1.00 | 1.0 | No |
| 2. USM 7942 | None | .48 | 3.6 | No |
| 3. USM 7942 | n-$C_4H_9NCO$ | .52 | 3.9 | Yes |
| 4. USM 7942 | p-$ClC_6H_4NCO$ | 1.04 | 0.8 | Yes |

As can be seen from the data set forth in Table I, in contrast to the electrophotographic film containing a non-endblocked polyester photoconductor matrix, the electrophotographic films containing polyester photoconductor matrices endblocked with n-butylisocyanate and para-chlorophenylisocyanate were readily flash fusible. Moreover, each of the isocyanate endblocked film samples also exhibited improved electrophotographic speed as compared with the non-endblocked film sample. Particularly notable is the significant increase in electrophotographic speed and improved dark decay properties exhibited by the film sample containing a polyester photoconductor matrix endblocked with para-chlorophenylisocyanate.

EXAMPLE II

Following the procedure of Example I, the relative electrophotographic speeds of electrophotographic films prepared from a variety of commercially available electrophotographic polyester resins and the aprotic modified forms thereof were measured. The electrophotographic speeds of each of these sample films were expressed relative to commercial James River Graphics P5-003 film, which was arbitrarily assigned a rating of 100. The results of this experiment are set forth in Table II.

TABLE II

| Relative Electrophotographic Speeds of Endblocked Matrix Based Films | | | |
|---|---|---|---|
| | Matrix Resin | | |
| Aprotic Group | Goodyear 321-1-SC-1 | USM 7977 | USM 7942 |
| As is | 490 | 330 | 515 |
| n-$C_4H_9NCO$ | 370 | — | — |
| $C_6H_5NCO$ | 660 | — | — |
| p-$ClC_6H_4NCO$ | 815 | 830 | 980 |
| 2,5-$Cl_2C_6H_3NCO$ | 620 | 870 | — |
| p-$NO_2C_6H_4NCO$ | 890 | — | — |

As can be seen therefrom, electrophotographic films containing polyester resins modified in accordance with the teachings of the instant invention, with the exception of n-butylisocyanate, all possessed significantly improved electrophotographic speed as compared with electrophotographic films containing the non-modified polyester photoconductor matrix. Particularly notable are the improvements in electrophotographic speed obtained through the use of para-chlorophenylisocyanate and para-nitrophenylisocyanate.

While the invention has now been described in terms of various preferred embodiments, and illustrated by numerous examples, the skilled artisan will readily appreciate that various modifications, changes, substitutions and admissions may be made without departing from the spirit thereof. Accordingly, it is intended that the scope of the present invention be defined by the scope of the following claims.

What is claimed is:

1. A photoconductive element suitable for use in electrophotography comprising a support having coated thereon a photoconductive composition comprising a photoconductor and a matrix for said photoconductor, said matrix comprising a linear, film-forming polyester resin having the terminal hydroxyl and carboxyl groups thereof modified with an aprotic group, said polyester resin having a number average molecular weight of from about 8,000 to about 50,000, wherein said aprotic group is a urethane group derived from a monoisocyanate, an ether group, an ester group, an amide group or a combination thereof.

2. The photoconductive element of claim 1, wherein said polyester resin comprises a polyester resin having a number average molecular weight of at least 12,000.

3. The photoconductive element of claim 2, wherein said aprotic group is a urethane group derived from a monoisocyanate, an amide group or combinations thereof.

4. The photoconductive element of claim 3, wherein said aprotic group is a group of the formulae $R^3NHCO$— or $R^3NHCOO$— wherein $R^3$ is an alkyl group having from 1 to 4 carbon atoms; a phenyl group; or a phenyl group substituted with a halogen, nitro, cyano, ester, tertiary amide group or combinations thereof.

5. The photoconductive element of claim 4, wherein $R^3$ is n-butyl; phenyl; p-chlorophenyl; 2,5-dichlorophenyl; p-cyanophenyl; or p-nitrophenyl.

6. The photoconductive element of claim 5, wherein $R^3$ comprises p-chlorophenyl.

7. The photoconductive element of claim 2, wherein said aprotic group is ether and ester groups and combinations thereof.

8. The photoconductive element of any of claims 3–7, wherein said polyester resin has a number average molecular weight of from about 12,000 to about 35,000.

9. The photoconductive element of claim 1, further comprising a sensitizer.

10. A photoconductive element comprising:

a. a conductive support comprising a transparent polyester film having a conductive coating selected from the group consisting of transparent vacuum deposited metal films, transparent films of semiconducting metal oxides, copper sulfide, cuprous iodide, and ionically conducting polymeric quaternary ammonium salt films; and b. a photoconductive insulating layer disposed on said support in contact with said conductive coating comprising from about 10 to about 60% by weight of an organic photoconductor selected from the group consisting of the substituted metaphenylene diamine, amine substituted triarylmethane, phenothiazine, phthalocyanine and aminofluorene photoconductors, and up to about 5% by weight of a sensitizer selected from the group consisting of the triarylmethane, oxazine, cyanine, pyrilium salt, thiapyrilium salt, charge transfer sensitizers and mixtures thereof dispersed in a linear, film-forming polyester resin binder having a number average molecular weight of from about 12,000 to about 35,000, said polyester resin having the terminal hydroxyl and carboxyl groups thereof reacted with an aprotic monoisocyanate compound.

11. The photoconductive element of claim 10, wherein said aprotic monoisocyanate compound is a compound of the formula $R^3NCO$, wherein $R^3$ is an alkyl group having from 1 to 4 carbon atoms, a phenyl group, or a phenyl group substituted with a halogen, nitro, cyano, ester, tertiary amide group or combinations thereof.

12. The photoconductive element of claim 11, wherein $R^3$ is n-butyl, phenyl, p-chlorophenyl, 2,5-dichlorophenyl, p-cyanophenol, or p-nitrophenyl.

13. The photoconductive element of claim 12, wherein $R^3$ comprise p-chlorophenyl.

* * * * *